US007300121B2

(12) United States Patent
Diebold et al.

(10) Patent No.: US 7,300,121 B2
(45) Date of Patent: Nov. 27, 2007

(54) SHELF FOR A REFRIGERATING APPLIANCE, IN PARTICULAR A BOTTLE SHELF FOR A BOTTLE-STORING COOLER CABINET

(75) Inventors: Jürgen Diebold, Hermaringen (DE); Günter Gomoll, Elchingen (DE); Siegfried Grasy, Dornstadt (DE); Bernd Pfister, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 399 days.

(21) Appl. No.: 10/744,738

(22) Filed: Dec. 22, 2003

(65) Prior Publication Data

US 2004/0135481 A1 Jul. 15, 2004

(51) Int. Cl.
*A47B 96/02* (2006.01)

(52) U.S. Cl. ..... 312/408

(58) Field of Classification Search ..... 312/404, 312/405.1, 408, 401, 410, 351; 211/74, 85.4, 211/85.18, 90.02, 88.01, 126.1, 133.5
See application file for complete search history.

(56) References Cited

U.S. PATENT DOCUMENTS 3,244,123 A * 4/1966 Pestritto et al. ..... 99/645
3,590,752 A * 7/1971 De Pew ..... 108/55.3
4,182,455 A * 1/1980 Zurawin ..... 211/85.18
4,242,848 A * 1/1981 Schoultz ..... 52/717.06
4,519,508 A * 5/1985 Gullett et al. ..... 211/59.2
4,960,308 A * 10/1990 Donaghy ..... 312/404
5,406,894 A * 4/1995 Herrmann et al. ..... 108/108
5,441,338 A * 8/1995 Kane et al. ..... 312/408
5,456,359 A * 10/1995 Horn ..... 206/378
6,082,557 A * 7/2000 Leahy ..... 211/59.3
6,189,707 B1 * 2/2001 Meyers et al. ..... 211/90.04
6,412,739 B1 * 7/2002 Smith ..... 248/217.2
2002/0066708 A1 * 6/2002 Gerard ..... 211/74
2004/0174108 A1 * 9/2004 Benitsch et al. ..... 312/408

* cited by examiner

*Primary Examiner*—David Dunn
*Assistant Examiner*—Noah Chandler Hawk
(74) *Attorney, Agent, or Firm*—Russell W. Warnock; Craig J. Loest; James E. Howard

(57) ABSTRACT

A shelf for refrigerating appliances, in particular a bottle shelf for a bottle-storage cabinet, has a frame, formed by transverse and longitudinal struts, and a plurality of trays which are retained one beside the other between two transverse struts of the frame and are intended for accommodating in each case one bottle. At least one of the transverse struts, over at least part of its cross section, is formed by an extruded profile made of a material that has a higher modulus of elasticity than the material of the longitudinal struts.

23 Claims, 2 Drawing Sheets

SHELF FOR A REFRIGERATING APPLIANCE, IN PARTICULAR A BOTTLE SHELF FOR A BOTTLE-STORING COOLER CABINET

BACKGROUND OF THE INVENTION

Field of the Invention

The present invention relates to a shelf for a refrigerating appliance, in particular a bottle shelf for a bottle-storing cooler cabinet for the temperature-controlled storage of bottles, in particular of wine bottles.

Such a bottle-storing cabinet generally contains a heat-insulating housing, a refrigerating installation for cooling a storage chamber in the interior of the housing, and, in the storage chamber, a plurality of shelves for accommodating bottles. Such a shelf contains a plurality of trays, which are each shaped in order to accommodate a bottle lying on its side, and a frame, on which the trays are retained one beside the other.

In the case of conventional refrigerators or cooler cabinets, it is common practice, inter alia, for refrigerated-item shelves which are to be installed in the storage chamber of such a refrigerator or cooler cabinet to be produced from a load-bearing glass panel which has its borders encapsulated in a plastic frame. When such a shelf has been installed in the refrigerating appliance, it is the frame that is in contact with the inner wall of the storage chamber and is fastened thereon; the glass panel itself is not in direct contact with the inner wall and is only supported via the frame. This method allows cost-effective production of the shelves, but cannot be used for a bottle shelf with a plurality of trays located one beside the other since, in the case of such a bottle shelf, bending loading from the weight of the shelf itself and from bottles mounted thereon can only be absorbed by crosspieces of the frame which connect the trays to one another. If these were to be produced, in a known manner, from injection-molded plastic, then it would be necessary either to accept pronounced bowing of the crosspieces, which is undesirable since such crosspieces are not reliably suspended on the side walls of the storage chamber and there is a risk of an overloaded shelf breaking out of its suspension device and crashing down, or to render the crosspieces so thick that they take up a not inconsiderable amount of the height of the interior and thus reduce the useable volume of the latter, which is likewise undesirable. The problem described above in the case of a bottle shelf made of injection-molded plastic also similarly arises in the case of refrigerated item shelves produced from injection-molded plastic.

It would, of course, be possible to produce the frame from a material with a modulus of elasticity which is higher than that of the plastics which are normally used for the frames of refrigerating-appliance shelves, in particular from metal, but this would increase the production costs to a considerable extent since such a metal would have to be die-cast in order to produce a single-piece frame or, for use in a multi-part frame, additional steps for joining the individual frame parts together would be necessary.

SUMMARY OF THE INVENTION

It is accordingly an object of the invention to provide a shelf for a refrigerating appliance that overcomes the above-mentioned disadvantages of the prior art devices of this general type, which is cost-effective to realize and, at the same time, can be subjected to high loading.

With the foregoing and other objects in view there is provided, in accordance with the invention, a shelf for a refrigerating appliance. The shelf contains a frame having transverse struts and longitudinal struts made of a first material. At least one of the transverse struts, over at least part of its cross section, is formed by an extruded profile made of a second material having a modulus of elasticity higher than that of the first material of the longitudinal struts. A set-down surface is provided and supported by the frame.

The object is achieved according to the invention in that, of the transverse struts of the frame of a shelf, at least one, over at least part of its cross section, is formed by an extruded profile made of a material which has a modulus of elasticity which is higher than that of the material which is used at least for the longitudinal struts of the frame. As a result, a refrigerated-item shelf which is produced from injection-molded plastic and is intended for use in a refrigerating compartment of a refrigerator or cooler cabinet is provided with very high load-bearing strength.

The material may be, in particular, aluminum or steel. In addition to the extruded profile, the transverse struts preferably also have crosspieces, which bear or accommodate the extruded profile and, connected integrally to the longitudinal struts, are formed from injection-molded plastic.

Such an extruded profile may be introduced, in particular, into a downwardly open groove of one of the crosspieces, with the result that the central region of such a crosspiece can rest, under bending loading, on the extruded profile.

In order, with low material outlay in respect of the extruded profile, to achieve a pronounced supporting action, the extruded profile should be higher than it is wide in cross section. It may have, for example, a cross section in the form of an upended rectangle. Since the fact that such a profile is included laterally in the groove of the crosspiece prevents the extruded profile from yielding laterally under bending loading, the loading capability of a strut which is made up of the extruded profile and the crosspiece enclosing the same laterally is considerably greater than the sum of the individual loading capabilities of the profile and of the crosspiece.

The extruded profile may also be disposed such that it covers over an outer side of one of the crosspieces. In particular if a metal such as aluminum or steel is used for the extruded profile, this provides the shelf as a whole with a high-quality appearance.

A U-shaped or C-shaped cross section of such an extruded profile makes it easier for the latter to be fastened on the crosspiece by plugging or clipping it on transversely to the longitudinal direction, or pushing it on in the longitudinal direction, of the profile.

It is preferable for at least one of the transverse struts to have a continuous bearing surface, on which trays for bearing bottles are supported at intervals from one another. In the interspaces between the trays, the bearing surfaces may be occupied in each case by spacer bodies, which ensure that the trays are placed at regular intervals without any need for measurement. Such spacer bodies may be supplied in different widths in order to provide, in modular fashion, bottle shelves which allow the space-saving storage of bottles with different diameters.

In one embodiment, the transverse struts have holes and the trays bear stubs engaging in the holes in the transverse struts. The transverse struts have crosspieces and the holes are preferably formed on an inner side of the crosspieces.

Other features which are considered as characteristic for the invention are set forth in the appended claims.

Although the invention is illustrated and described herein as embodied in a shelf for a refrigerating appliance, in particular a bottle shelf for a bottle-storing cooler cabinet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
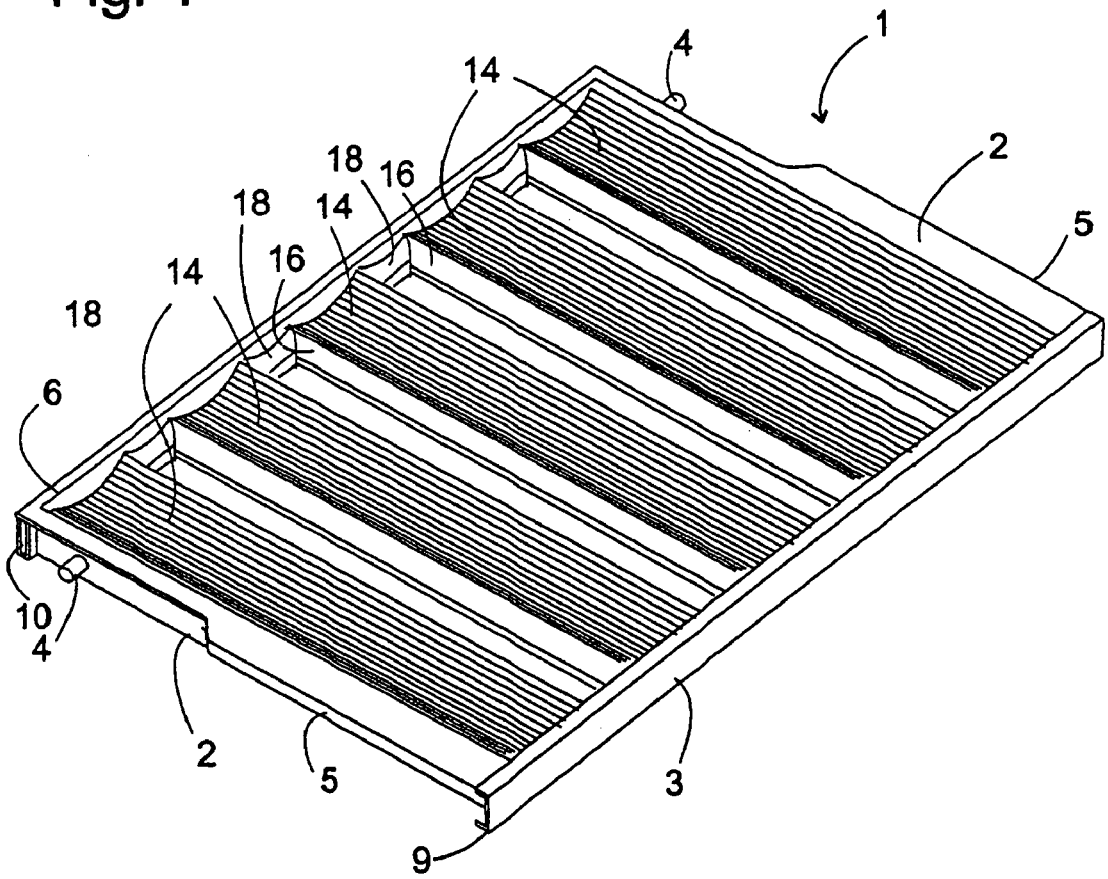
FIG. 1 is a diagrammatic, perspective view of a bottle shelf according to the invention.

Referring now to the figures of the drawing in detail and first, particularly, to FIG. 1 thereof, there is shown a bottle shelf that is made up of a four-sided frame 1 with longitudinal struts 2 and transverse struts 3, 6. When installed in a bottle-storing cabinet, the longitudinal struts 2 extend along the side walls of a storage chamber of the cabinet. A cylindrical stub 4 and a horizontally elongate rib 7 are provided in order to engage in guiding cut-outs in the side wall and thus to support the shelf.

The transverse struts 3, 6 each extend along a rear wall or a door of the storage cabinet. As can better be seen in the section of FIG. 2, the transverse struts 3, 6 each have a two-part construction with a crosspiece 7, 8, which is injection molded integrally to the longitudinal struts from plastic, and an extruded profile 9, 10, which is made of metal, in particular of aluminum or stainless steel, and reinforces the respective crosspiece 7, 8.

In the case of the transverse strut 6 which is directed toward the rear wall of the storage cabinet, the extruded profile 10 has a cross section in the form of an upended rectangle and fills a downwardly open groove of the cross piece 8 in a form-fitting manner. The extruded profile 10 thus merely has a reinforcing function, and it is not normally visible to a user.

Figure 2:
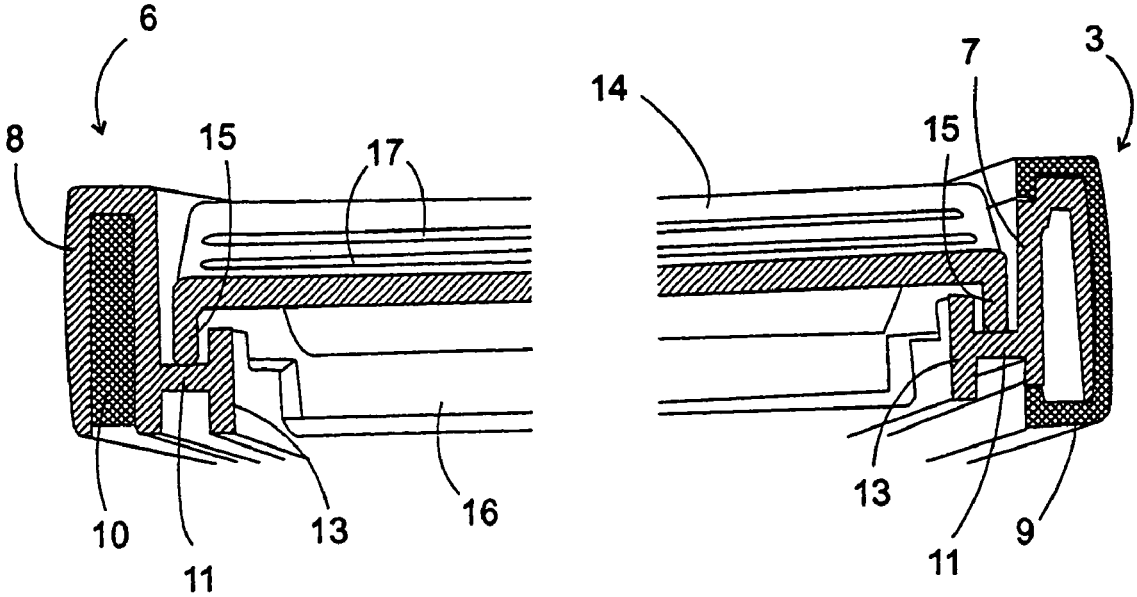
FIG. 2 is a broken, longitudinal sectional view through a first configuration of the bottle shelf.

Instead of being introduced into a groove, it would be also be possible for the extruded profile 10 to be introduced into a bore extending over the length of the transverse strut 6, but such a bore is more difficult to produce by injection molding than the groove that is shown in FIG. 2, and so the groove is the preferred variant.

In the case of the transverse strut 3 which is directed toward the door, the crosspiece 7, which is integral with the longitudinal struts 2, is located in the interior and is enclosed on three sides by the C-shaped extruded profile 9, this causing the crosspiece 7 to be virtually completely hidden from a view of the user. The extruded profile 9 can be displaced in the longitudinal direction of the crosspiece 7 and can thus be plugged onto the longitudinal strut 2, or removed therefrom, when the strut 2 is not installed in the storage cabinet. An extruded profile with a U-shaped cross section could also be plugged onto the crosspiece 7 and removed therefrom, in the longitudinal direction of the longitudinal struts 2. It would also be conceivable for the crosspiece 7 to be provided with a partly flexible cross section with pliable lugs which, when a C-shaped profile is plugged on, first yields in the longitudinal direction of the longitudinal struts 2 and, as soon as the profile has reached its end position, engage behind the inwardly directed end sections of the profile and prevent withdrawal in the opposite direction.

Bearing surfaces 11 are integrally formed on the mutually facing inner sides of the crosspieces 7, 8, the bearing surfaces extending over the entire length of the crosspieces 7, 8 and, for reinforcing purposes, being terminated in each case by a bar 13 with a cross section in the form of an upended rectangle. Bottle trays 14 are supported on the bearing surfaces 11. The bottle trays 14, which are injection molded from plastic, are essentially in the form of a cylinder-wall segment which is reinforced along the longitudinal and transverse borders in each case by vertically downwardly directed walls 15, 16. The walls 15, which are integrally formed at the longitudinal ends of the tray 14, each engage between a crosspiece 7, 8 and the bars 13, integrally formed thereon, and are supported on the bearing surface 11 located therebetween. The presence of the bars 13 prevents the merely loosely positioned trays 14 from being able to slide off from the bearing surfaces 11, and crash down, as a result of twisting or bowing when overloaded.

A plurality of flat ribs 17 which extend in the longitudinal direction on the top side of the tray 14 prevent large-surface-area contact between the tray 14 and a bottle which is lying thereon, with the result that it is not possible for condensation, which could result in a bottle label being damaged, to collect between the tray 14 and bottle on a permanent basis.

As FIG. 1 shows, in interspaces between the trays 14, the bearing surfaces 11 are concealed by spacer bodies 18. The spacer bodies 18, which may be formed, for example, of a rubber-like material, are each plugged in a force-fitting manner between the crosspiece 7 or 8 and the associated bar 13. Of the spacer bodies 18, a number of sets of different widths may be made available as an accessory to the shelf according to the invention, the widths thereof being adapted to those of the frame 1 in each case such that they allow different numbers of trays 14 to be placed at regular intervals in the frame 1.

Figure 3:
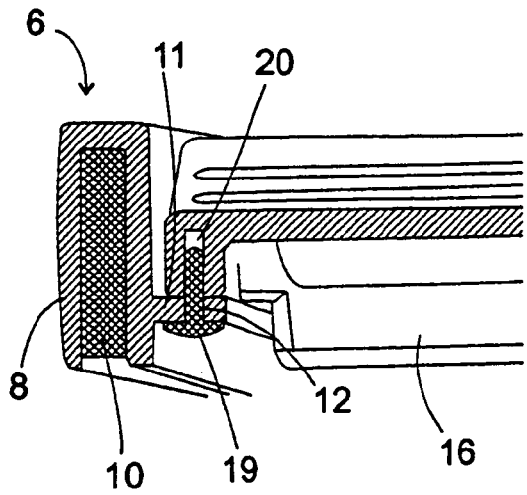
FIG. 3 is a broken, longitudinal sectional view through a second configuration of the bottle shelf.
Figure 3:
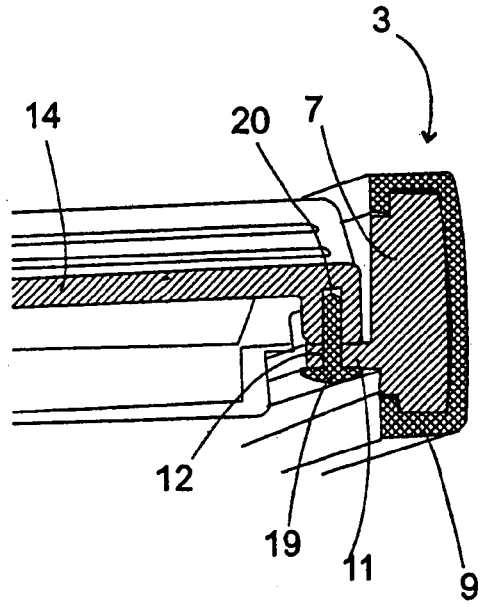

FIG. 3 shows a longitudinal section through a second configuration of the shelf according to the invention. The transverse struts 3, 6 of this configuration differ from those of FIG. 2 by way of the configuration of the bearing surfaces 11. These are not terminated by the bar 13 in the case of the configuration of FIG. 3; instead, they are provided at regular intervals with holes 12 through which a screw 19 can be respectively inserted and tightened in a threaded bore 20 of a tray 14. The trays 14 are thus not just positioned loosely, but fastened on the frame 1 on a permanent basis.

As a result of the position of the holes 12 in the bearing surfaces 11 and of the threaded bores 20 in the trays 14 in this configuration, the positions which can be taken up by the trays 14 on the frame are fixed and cannot be varied, with the result that it is also the case that it is not readily possible to vary the number of trays in a frame. A variant of the configuration allows the trays 14 to be placed at variable intervals by replacing the threaded bores 20 by grooves 20 which are oriented parallel to the transverse struts 3, 6 and of which the width is dimensioned in each case such that the screws 19 cut threads into the side flanks of the grooves 20. Such a tray 14 can be fastened in any desired position along the bearing surface 11 in which the groove 20 ends up located over one of the holes 12 of the bearing surface 11. Here too, the spacer bodies 18 are placed between the trays 14 on the bearing surfaces 11 in order to cover over holes 12 in the bearing surfaces where there is no tray 14 screw-connected. The spacer bodies 18 may simply be clamped in between the bottle trays 14 or, as is the case with the latter, they may be provided with a groove, which allows them to be screw-connected to the bearing surfaces 11.

Figure 4:
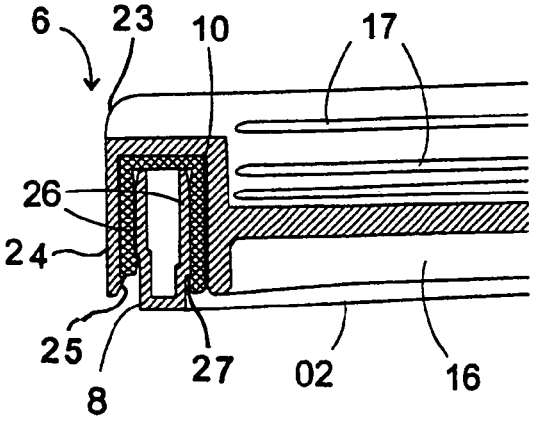
FIG. 4 is a broken, longitudinal sectional view through a third configuration of the bottle shelf.
Figure 4:
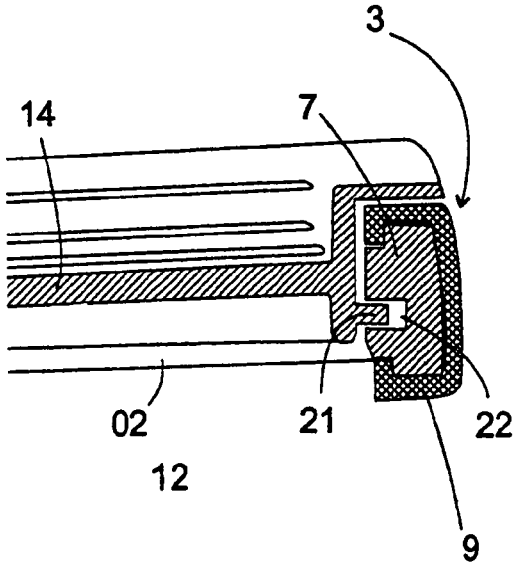

In the case of the configuration of FIG. 4, the top sides of the transverse struts 3, 6 themselves in each case serve as bearing surfaces for extensions 23 of the trays 14. The trays 14 are fixed in the transverse direction by integrally formed stubs 21, which each engage in blind holes 22 in the inner side of the crosspiece 7, the inner side not being visible to an observer. The blind holes 22 may be disposed in the rear side in the form of a number of groups, the holes of one group being spaced apart from one another in each case by the same intervals, but the number of holes, and the intervals between them, differing from group to group, with the result that, depending on which group of holes is used, it is possible to install different numbers of trays at regular intervals.

The rear extension 23 is continued by a downwardly directed tongue 24 which, by way of a latching hook 25 integrally formed at its end, engages behind an edge of the rear transverse strut 6. The trays 14 in this configuration are particularly straightforward to install, in that they are initially retained in a sloping position and, in the process, introduced into the blind holes 22 by way of their stubs 21 and then pivoted downward until they latch in at the rear transverse strut 6

The rear transverse strut 6 is formed by the crosspiece 8, which is formed integrally with the longitudinal struts 2 from plastic, and a C-shaped extruded profile 10, which is fitted over the crosspiece 8 from above. The crosspiece 8 has an approximately U-shaped cross section with two vertical legs 26, which have latching edges 27 formed on their outer sides. When the extruded profile 10 is fitted over, the two legs 26 are initially pressed elastically toward one another. As soon as latching noses of the profile 10 have passed the edges 27, the legs 26 spread apart again, with the result that the edges 27 engage behind the latching noses and anchor the profile 10 firmly on the crosspiece 8.

In the case of those exemplary embodiments of the shelf according to the invention which are shown, the longitudinal struts 2 of the frame 1 are narrow and serve merely to provide a rigid connection between the transverse struts 3, 6. As an alternative, it would also be possible to widen the longitudinal struts 2 so that they themselves form an accommodating tray for a bottle in each case.

We claim:

1. A bottle shelf for a refrigerating appliance, comprising:

a frame having transverse struts and longitudinal struts made of a first material, at least one of said transverse struts, over at least part of its cross section, being formed by an extruded profile made of a second material having a modulus of elasticity higher than that of said first material of said longitudinal struts;

a plurality of trays secured between two of said transverse struts of said frame and provided for accommodating at least one bottle;

at least one of said transverse struts having a bearing surface supporting said trays at intervals from one another, the position of at least one tray being adjustable with respect to the frame and with respect to at least one other tray; and wherein the bearing surface includes a plurality of holes, at least one tray including an end wall extending downwardly from an end of the at least one tray and having a bore, a threaded fastener extending through at least one of the plurality of holes and engaging the bore to retain the at least one tray in a desired position.

2. The shelf according to claim 1, wherein:

said transverse struts have holes formed therein; and said trays bear stubs engaging in said holes in said transverse struts.

3. The shelf according to claim 2, wherein said transverse struts have crosspieces and said holes are formed on an inner side of said crosspieces.

4. The shelf according to claim 1, wherein two of the plurality of trays are spaced apart from one another on the bearing surface, a spacer body being disposed on the bearing surface between the two trays to retain at least one of the trays in a desired position.

5. A refrigerator shelf comprising:

a frame including transverse struts and longitudinal struts extending between the transverse struts and being formed from a first material, each transverse strut including a crosspiece formed from the first material and an extruded profile portion formed from a second material having a modulus of elasticity higher than that of the first material;

a plurality of separate trays extending between the transverse struts for accommodating a bottle, the position of at least one tray being adjustable with respect to the frame and with respect to at least one other tray;

wherein each transverse strut includes a bearing surface supporting respective ends of each tray; and wherein each bearing surface includes a plurality of holes, at least one tray including an end wall extending downwardly from each respective end and having a bore, a threaded fastener extending through at least one of the plurality of holes and engaging one of the bores to retain the at least one tray in a desired position.

6. The refrigerator shelf according to claim 5, wherein the first material includes a plastic material.

7. The refrigerator shelf according to claim 5, wherein the second material includes a metal material.

8. The refrigerator shelf according to claim 5, wherein the crosspieces and the longitudinal struts are integrally formed with one another.

9. The refrigerator shelf according to claim 5, wherein the crosspiece at least partially surrounds the extruded profile portion of one of the transverse struts, and the extruded profile portion at least partially surrounds the crosspiece of the other of the transverse struts.

10. The refrigerator shelf according to claim 5, wherein at least one tray includes a semi-cylindrical wall segment extending in a longitudinal direction along the tray for receiving the bottle, a plurality of ribs extending along the wall segment and spacing the bottle apart from the surface of the wall segment.

11. A refrigerator shelf comprising:

a frame including transverse struts and longitudinal struts extending between the transverse struts and being formed from a first material, each transverse strut including a crosspiece formed from the first material and an extruded profile portion formed from a second material having a modulus of elasticity higher than that of the first material;

a plurality of separate trays extending between the transverse struts for accommodating a bottle, the position of at least one tray being adjustable with respect to the frame and with respect to at least one other tray;

wherein each transverse strut includes a bearing surface supporting respective ends of each tray; and wherein each bearing surface includes a plurality of holes, at least one tray including an end wall extending downwardly from each respective end and defining a groove extending along the end wall, a threaded fastener extending through at least one of the plurality of holes and engaging one of the grooves to retain the at least one tray in a desired position.

12. The refrigerator shelf according to claim 11, wherein the first material includes a plastic material.

13. The refrigerator shelf according to claim 11, wherein the second material includes a metal material.

14. The refrigerator shelf according to claim 11, wherein the crosspieces and the longitudinal struts are integrally formed with one another.

15. The refrigerator shelf according to claim 11, wherein the crosspiece at least partially surrounds the extruded profile portion of one of the transverse struts, and the extruded profile portion at least partially surrounds the crosspiece of the other of the transverse struts.

16. The refrigerator shelf according to claim 11, wherein at least one tray includes a semi-cylindrical wall segment extending in a longitudinal direction along the tray for receiving the bottle, a plurality of ribs extending along the wall segment and spacing the bottle apart from the surface of the wall segment.

17. A refrigerator shelf comprising:

a frame including transverse struts and longitudinal struts extending between the transverse struts and being formed from a first material, each transverse strut including a crosspiece formed from the first material and an extruded profile portion formed from a second material having a modulus of elasticity higher than that of the first material;

a plurality of separate trays extending between the transverse struts for accommodating a bottle, the position of at least one tray being adjustable with respect to the frame and with respect to at least one other tray;

wherein each transverse strut includes a bearing surface supporting respective ends of each tray; and wherein each bearing surface is disposed on an upper surface of each transverse strut, one of the transverse struts having multiple holes aligned along an inwardly facing side of the transverse strut, at least one tray having extensions extending from each respective end over one of the bearing surfaces, a stub projecting from one of the ends of the at least one tray and engaging one of the multiple holes to retain the at least one tray in a desired position.

18. The refrigerator shelf according to claim 17, wherein the other of the ends of the at least one tray includes a tongue extending downwardly from the corresponding extension and having a latching hook engaging the adjacent transverse strut.

19. The refrigerator shelf according to claim 17, wherein the first material includes a plastic material.

20. The refrigerator shelf according to claim 17, wherein the second material includes a metal material.

21. The refrigerator shelf according to claim 17, wherein the crosspieces and the longitudinal struts are integrally formed with one another.

22. The refrigerator shelf according to claim 17, wherein the crosspiece at least partially surrounds the extruded profile portion of one of the transverse struts, and the extruded profile portion at least partially surrounds the crosspiece of the other of the transverse struts.

23. The refrigerator shelf according to claim 17, wherein at least one tray includes a semi-cylindrical wall segment extending in a longitudinal direction along the tray for receiving the bottle, a plurality of ribs extending along the wall segment and spacing the bottle apart from the surface of the wall segment.

* * * * *

UNITED STATES PATENT AND TRADEMARK OFFICE

CERTIFICATE OF CORRECTION

PATENT NO. : 7,300,121 B2
APPLICATION NO. : 10/744738
DATED : November 27, 2007
INVENTOR(S) : Diebold et al.

It is certified that error appears in the above-identified patent and that said Letters Patent is hereby corrected as shown below:

Title page

Item 30: Insert

--(30) Foreign Application Priority Data
Dec. 22, 2002 (DE) .....102 60 182.8--

Signed and Sealed this
First Day of March, 2011

David J. Kappos

David J. Kappos
*Director of the United States Patent and Trademark Office*